US006089178A

United States Patent [19]

Yamamoto et al.

[11] Patent Number: 6,089,178

[45] Date of Patent: Jul. 18, 2000

[54] SUBMERSIBLE VEHICLE HAVING SWINGING WINGS

[75] Inventors: Ikuo Yamamoto; Katsuya Daigo, both of Nagasaki; Yuuzi Terada, Kobe, all of Japan

[73] Assignee: Mitsubishi Heavy Industries, Ltd., Tokyo, Japan

[21] Appl. No.: 09/143,248

[22] Filed: Aug. 28, 1998

[30] Foreign Application Priority Data

Sep. 18, 1997 [JP] Japan ..... 9-272077
Apr. 15, 1998 [JP] Japan ..... 10-121715

[51] Int. Cl.[7] ..... B63G 8/08

[52] U.S. Cl. ..... 114/337; 440/13; 440/14

[58] Field of Search ..... 114/312, 333, 114/313, 337, 144 R; 440/15, 14, 13

[56] References Cited

U.S. PATENT DOCUMENTS 2,936,729 5/1960 Kuttner ..... 440/15
3,463,108 8/1969 Neumeier ..... 114/333
3,874,320 4/1975 Wood ..... 440/15

FOREIGN PATENT DOCUMENTS 6219384 8/1994 Japan .
7215292 8/1995 Japan .

OTHER PUBLICATIONS

The Design of a Free Swimming Robot Pike, J. Kumph, Massachusetts Institute of Technology, May 1996.

Concept Design of a Flexible Hull, J. Anderson et al, Draper Laboratory, Cambridge, Mass., May 1997.

*Primary Examiner*—Stephen Avila
*Attorney, Agent, or Firm*—John P. White; Cooper & Dunham LLP

[57] ABSTRACT

A submersible vehicle is a type having swinging wings. The vehicle is provided with a vehicle main body, a plurality of swinging wings provided for the main body and arranged in series, rotatable shafts located at front edges of the swinging wings, respectively, actuators for driving the shafts independently of one another, and a wing controller for controlling the actuators in such a manner that the wings enable to swing in a flexible manner like the tail fin of a fish, thereby producing a desired propelling force and performing a steering operation.

2 Claims, 5 Drawing Sheets

SUBMERSIBLE VEHICLE HAVING SWINGING WINGS

BACKGROUND OF THE INVENTION

The present invention relates to submersible vehicles, such as an artificial fish, a submersible research vehicle and a submersible work barge, and more particularly to vehicles that generate a propelling force by means of swinging wings.

What is shown in FIG. 1 is a conventional submersible vehicle 100 that generates a propelling force by means of a screw propeller 101. In this type of submersible vehicle 100, the propelling force generated by the screw propeller 101 acts only in the direction of the axis of rotation. In order to control the traveling direction of the submersible vehicle 100, auxiliary devices, such as a rudder 102 and a side thrustor 103, are provided for the side and stem of the submersible vehicle 100. This type of submersible vehicle 100 can travel linearly in a satisfactory manner but the direction control and position maintaining control thereof are restricted.

The use of the screw propeller 101 and the side thrustor 103 is disadvantageous in that when they are used, they may catch objects around them during rotation. For this reason, the submersible vehicle 100 is sometimes restricted in use for the purpose of ensuring safety.

Accordingly, an object of the present invention is to provide a submersible vehicle which can be not only moved forward or backward but also steered by oscillating or swinging the wings in such a manner that they move like the fins of a fish.

BRIEF SUMMARY OF THE INVENTION

To solve the problems described above, the submersible vehicle of the present invention comprises: a plurality of pairs of wings which are swung by the reversible rotation of the rotating shafts coupled to the front edges of the wings and which are provided for a main body and arranged in series; actuators for rotating the wings; and a wing controller, the wing controller including: a wing command generator for outputting a control signal by which the amplitudes, frequencies, centers of oscillation, and phases of the wings are controlled during the reversible rotation of the shafts, so that the shafts are controlled to rotate in cooperation with one another; an angle servo driver for converting control signals output from the wing command generator into signals used for driving the shafts, thereby controlling the actuators corresponding to the rotating shafts.

The submersible vehicle of the present invention further comprises: a tank with reference to which water can be poured or drained so as to control the underwater position of the vehicle; and a control mechanism for controlling the amount of water poured into or drained from the tank.

In the submersible vehicle of the present invention, a plurality of pairs of wings, which are swung by the reversible rotation of shafts coupled to the front edges of the wings, are arranged in series. The amplitudes, frequencies, centers of oscillation and phases of the wings are controlled in association with one another, in such a manner that the wings smoothly swing as a whole as if they were fish fins. Owing to the swinging motion of the wings, the vehicle can be propelled and steered in a desired manner. The submersible vehicle of the present invention is therefore free of the problem arising from the use of the conventional screw propeller.

In the case where the rotating shafts are arranged to extend horizontally, the wings can operate as if they were the rudder of a submarine or move as if they were fish fins. Accordingly, the periscope depth range or the underwater position of the vehicle can be varied.

In the case where the submersible vehicle is provided with a tank with reference to which water can be poured or drained, the tank serves as if it were. the swim bladder of a fish. In other words, the tank serves to control the buoyant force of the vehicle. Accordingly, the sinking and floating of the vehicle (i.e., the underwater position of the vehicle) can be smoothly controlled.

The present invention also provides another type of submersible vehicle provided with swinging wings. In this alternative submersible vehicle, the proximal ends of the swinging wings are coupled to the two sides of the main body. The wings are swung around a vertical axis by means of first actuators, and the swinging motion of the wings is controlled with reference to a horizontal axis by means of second actuators. The submersible vehicle comprises a wing controller. This controller controls the first and second actuators in such a manner that the submersible vehicle can be propelled or steered by the swinging wings.

The submersible vehicle described above can move forward or backward in the state where the wings are swung by the first actuators and the movable angle range of them is simultaneously controlled by means of the second actuators. When the submersible vehicle is moved forward, the wings are driven by the first actuators in such a manner that the wings are stretched forward or sideways. After the second actuators set the wings in the wing angle state where the wing planes are vertical, the wings are swung backward by the first actuators, thereby producing a propelling force used for forward movement. In order to return the wings into the original state, i.e., the state where they are stretched forward or sideways, the wing planes of the swinging wings are made horizontal to reduce the water resistance. The propelling force for forward movement is generated with high efficiency by repeatedly driving the swinging wings in succession in such a manner to swing the wings back and forth.

The submersible vehicle is moved backward by driving the wings in the opposite fashion. To be more specific, the swinging wings are first stretched backward, and are then swung to the forward or sideways position, with the wing planes kept vertical. By this operation, the propelling force for backward movement is generated.

The vehicle can be steered by generating different magnitudes of propelling force between the swinging wings on the right and left sides of the vehicle.

The present invention further provides a submersible vehicle that comprises swinging wings each made up of: a large number of skeleton members coupled at proximal ends to the side portions of the main body of the vehicle in such a manner as to extend sideways, spaced from one another such that they can be swung around axes extending in the longitudinal axis of the vehicle; and a flexible wing member attached to the skeleton members. In addition to the swinging wings, the submersible vehicle may comprise a wing controller that controls the propelling movement or the steering operation by individually controlling the swinging motions of the skeleton members.

The submersible vehicle of the present invention described above is designed in such a manner that the oscillation phase are regularly shifted when the skeleton members coupled to the wings are swung. Accordingly, the flexible wing member attached to the skeleton members can wave just like the fins of a ray (fish). When the wave of the flexible wing member surges backward, the propelling force for forward movement is generated. Conversely, when the wave surges forward, the propelling force for backward movement is generated.

As in the above case, the vehicle can be steered by generating different magnitudes of propelling force between the swinging wings on the right and left sides of the vehicle.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

Embodiments of the present invention will now be described with reference to the accompanying drawings.

Figure 1:
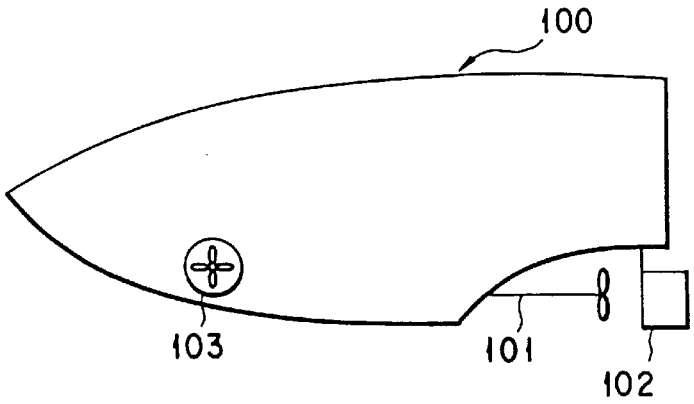
FIG. 1 (PRIOR ART)
FIG. 1 is a side view of a conventional submersible vehicle.
Figure 2:
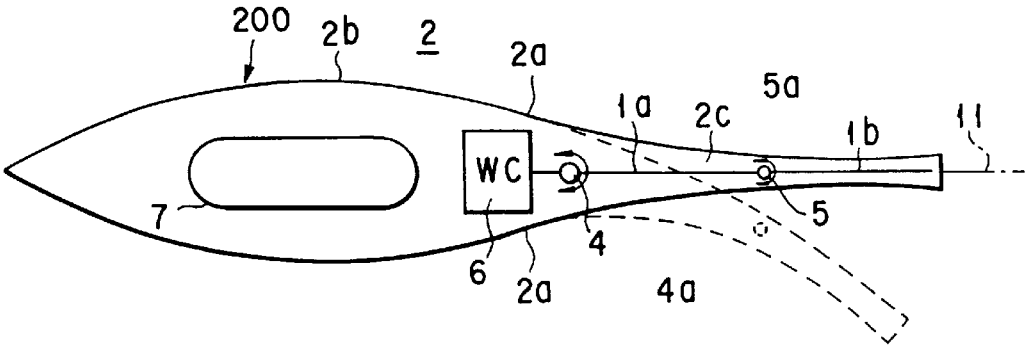
FIG. 2 is a plan view schematically showing the internal structure of a submersible vehicle with swinging wings, the submersible vehicle being obtained according to the first embodiment of the present invention.
Figure 3:
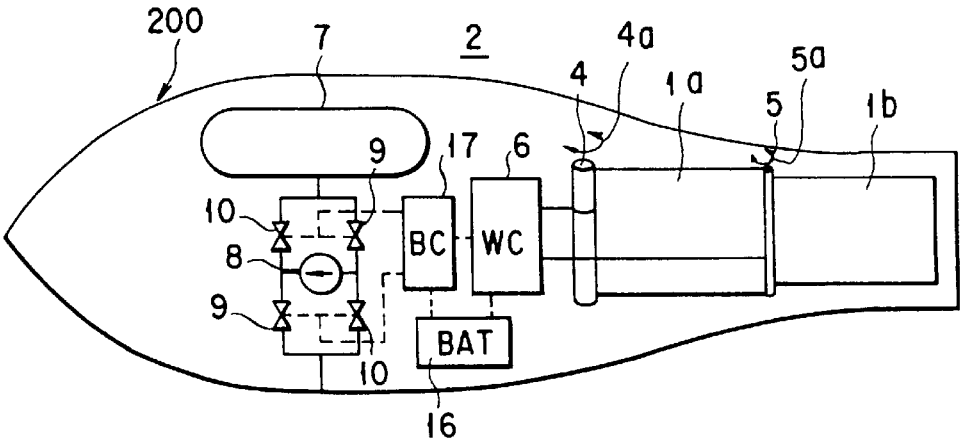
FIG. 3 is a side view schematically showing the internal structure of the submersible vehicle shown in FIG. 2.
Figure 4:
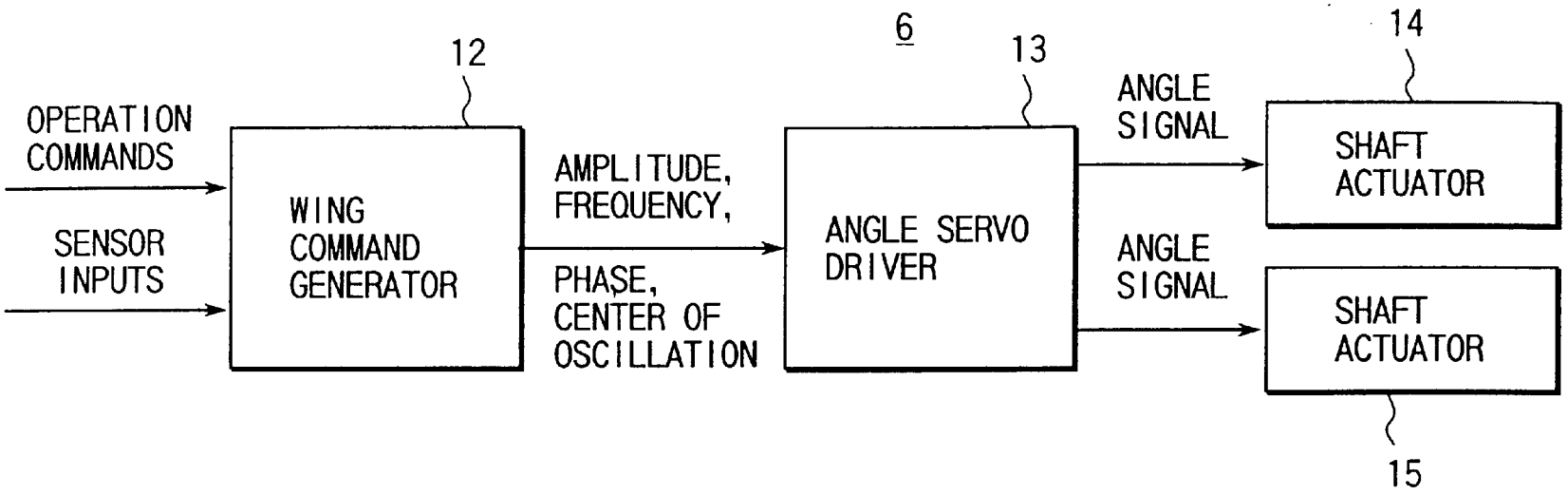
FIG. 4 is a block circuit diagram showing a wing control system employed in the submersible vehicle shown in FIGS. 2 and 3.

As shown in FIGS. 2 and 3, the submersible vehicle according to the first embodiment is made up of a main body 200, and a mechanism for propelling and/or steering (hereinafter referred to simply as a propelling/steering mechanism).

The propelling/steering mechanism employed in the first embodiment will be described. The submersible vehicle 2 of the first embodiment comprises two wings (swinging wings) 1*a* and 1*b*. These two wings are located inside the tail portion of the main body 200 and arranged in series. A rotating shaft 4 is arranged at the forward end of the swinging wing 1*a*, so as to oscillate (or swing) the swinging wing 1*a*. The rotating shaft 4 is rotatable in opposite directions, as indicated by 4*a* in FIG. 2. Another rotating shaft 5 is arranged at the forward end of the swinging wing 1*b* (i.e., at the rear end of the swinging wing 1*a*), so as to oscillate (or swing) the swinging wing 1*b*. The rotating shaft 5 is rotatable in opposite directions, as indicated by 5*a* in FIG. 2.

The rotating shafts 4 and 5 are driven by the wing controller (WC) 6. The wing controller (WC) 6 is arranged inside the main body, and is made up of a wing command generator 12, angle servo driver 13 and actuators 14 and 15, as shown in FIG. 3. The rotating shafts 4 and 5 are rotated by the actuators 4 and 5 in the directions indicated by reference symbols 4*a* and 5*a*. The wing controller (WC) 6 is applied with power from a battery (BAT).

The angle servo driver 13 drives the actuators 14 and 15 such that the rotating shafts 4 and 5 of the swinging wings 1*a* and 1*b* can be controlled in association with each other. The wing command generator 12 supplies a control signal to the angle servo driver 13 so as to control the amplitudes, frequencies, phases and centers of oscillation of the swinging wings 1*a* and 1*b*.

The submersible vehicle 2 is designed such that the tail portion of the main body 200 can smoothly curve in accordance with the operation of each swinging wing 1*a* and 1*b*, as shown in FIG. 2. In order for the tail portion to smoothly curve, the swinging wings 1*a* and 1*b* are housed in a flexible cover 2*c* formed of a soft fiber-reinforced plastic (FRP) material. This flexible cover 2*c* is coupled to the predetermined portion 2*a* of a rigid or flexible front cover 2*b*.

The submersible vehicle 2 of the first embodiment is provided with a tank 7. Water can be poured into the tank 7 or drained therefrom, so that the floating and sinking of the submersible vehicle 2 (namely, the underwater position of the vehicle 2) can be controlled. As shown in FIG. 3, a water pouring/draining control mechanism provided for the tank 7 comprises a pump 8, changeover valves 9 and 10, piping, and a buoyant force controller (BC) 17 for controlling the pump 8 and the valves 9 and 10 to adjust the buoyant force of the tank 7.

To control the swinging wings 1*a* and 1*b* of the submersible vehicle, the wing command generator 12 and the buoyant force controller (BC) 17 are operated. The amount of operation of the wing command generator 12 and the control by the buoyant force controller (BC) 17 are determined by the following procedures:

(A1) The force which should be given to the submersible vehicle 2 is decomposed into a horizontal component and a vertical component.

(A2) The magnitude of the horizontal component is adjusted on the basis of the amplitudes and frequencies of the shafts 4 and 5. The direction in which the force acts (i.e., the forward movement or backward movement) is adjusted in accordance with the phases of the shafts 4 and 5. The direction in which the horizontal component acts, which is controlled for steering the vehicle, is determined by adjusting the length by which the centers of oscillation of the wings 1*a* and 1*b* are deviated from the central axis 11 of the submersible vehicle.

The magnitude of the vertical component of the force is related to the control of the buoyant force. It is controlled by adjusting the amount of water contained in the tank 7. The amount of water is adjusted by means of the pump 8 and valves 9 and 10.

The wing command generator 12 is supplied with operating commands (a propelling force, a turning angle, a buoyant force, etc.) and outputs from sensors (e.g., an output from a speed sensor). On the basis of the operating commands and the sensor outputs, the wing command generator 12 outputs amplitudes and frequencies the rotating shafts 4 and 5 should take (a sinusoidal wave is used as a reference wave), and further outputs phase relationships between the rotating shafts 4 and 5 and centers of oscillation. These outputs determine the manner in which the swinging wings 1*a* and 1*b* are moved. The term "center of oscillation" is intended to refer to the angle formed between the central axis 11 of the vehicle 2 and the center position of the swing angle range of the swinging wing 1*a* or 1*b*. The angle servo driver 13 receives outputs from the swinging wing command generator 12 and converts them into angle signals for the rotating shafts 1*a* and 1*b*. On the basis of these angle signals, the actuators 14 and 15 are driven. The wing controller (WC) 6 and the buoyant force controller (BC) 17 executes control in accordance with the following procedures B1 to B3:

(B1) Learning by Swinging Wing Command Generator 12 (Preparations)

The speed of the submersible vehicle 2 (the relative speed if there is a water stream), the amplitude and frequency which the swinging wing 1 should take for each propelling force, and the phase difference are calculated as follows:

(B1-1) The submersible vehicle 2 is fixed inside a water tank, and a strain gauge is attached to the submersible vehicle 2 so as to measure the propelling force.

(B1-2) A stream is produced in the water tank, and the swinging wings 1*a* and 1*b* is operated to generate a propelling force. The speed of the submersible vehicle 2 is processed as a flow rate of the stream.

(B1-3) Of the various combinations among the amplitude, frequency and phase difference of the swinging wings 1*a* and 1*b*, the combination that permits the total amount of power consumed by the actuators 14 and 15 to become smallest when a predetermined propelling force is generated, is chosen in the saddle point method.

(B1-4) Procedures (B1-2) and (B1-3) noted above are executed on the basis of several combinations between the speed and the propelling force. Data obtained thereby are described in the form of a two-dimensional table in such a manner that the relationships between the speed and the propelling force can be easily detected.

(B2) How to operate the Wing controller (WC) 6:

After the leaning by the wing command generator 12 is completed in accordance with the above procedures, the wing controller (WC) 6 controls the swinging wings 1*a* and 1*b* on the basis of the procedures (B2-1) to (B2-4) described below.

(B2-1) The wing command generator 12 is supplied with a propelling force (which is one of operating commands externally input in a wireless manner) and a speed detected by a speed sensor (i.e., a signal supplied from the speedometer attached to the submersible vehicle 2). On the basis of the input operating command and the detected speed, the wing command generator 12 interpolates the data described in the table obtained by the learning in procedure (B1). After this interpolation, the amplitude, frequency and phase difference are output.

(B2-2) The wing command generator 12 is supplied with data on the turning angle corresponding to the operating command. The wing command generator 12 multiplies the turning angle by a predetermined coefficient and outputs the resultant value as representing the center of oscillation. The coefficient is determined in such a manner that a maximal value representing the center of oscillation can be normalized on the basis of a maximal value representing the turning angle signal.

(B2-3) The angle servo driver 13 outputs angle signals used for actuators 14 and 15 on the basis of the following formulas:

$$(\text{Angle Signal for Actuator } \mathbf{14}) = A\sin(\omega t) + K$$

$$(\text{Angle Signal for Actuator } \mathbf{15}) = A\sin(\omega t + \alpha) + K$$

where A is an amplitude (maximal angle), ω is a frequency (angular frequency), K is the center of oscillation, and t is a time, all of which are output from the wing command generator 12.

(B2-4) In accordance with the angle signals obtained in procedure (B2-3), the rotating shaft actuators 14 and 15 swings the wings.

(B3) Control by Buoyant Force Controller (BC) 17:

The buoyant force controller (BC) 17 adjusts the buoyant force by following procedures (B3-1), (B3-2) and (B3-4) below.

(B3-1) The buoyant force corresponding to the operating command is analyzed to check the direction in which the force should act and the magnitude of the force.

(B3-2) Where the direction of the buoyant force indicates upward movement, the drain valve 9 is opened and the water supply valve 10 is closed. Where the direction of the buoyant force indicates downward movement, the water supply valve 10 is opened and the drain valve 9 is closed.

(B3-3) The output of the water supply/drain pump 8 is controlled in accordance with the magnitude of the buoyant force.

(B3-4) When the flow rate measured at the inlet of the tank 7 (which serves as a swim bladder) becomes 0, this means the tank 7 becomes either full or empty. In this case, therefore, the water supply/drain pipe 8 is stopped.

With the submersible vehicle of the present invention of the first embodiment, it is possible to perform three-dimensional control when the vehicle is propelled (moved forward or backward), is turned, or is changed in underwater position. As described above, the wings 1*a* and 1*b*, which are swung in accordance with the reversible rotation of the shafts 4 and 5 secured to the front edges of the wings, are arranged in series with each other, and the amplitudes, frequencies, centers of oscillation and phase of the wings 1*a* and 1*b* cooperate with one another. Accordingly, the wings 1*a* and 1*b* are driven as if they were like fins of a fish, such that a desired propelling force is generated and a desired steering operation is performed. Unlike the conventional screw propeller type submersible vehicle, the submersible vehicle of the first embodiment, which is provided with swinging wings, does not catch objects around the vehicle.

If the rotating shafts 4 and 5 are arranged on the side of the main body 200, the wings driven by such shafts work like pectoral fins of a fish and thus permits the vehicle to change in underwater position.

The submersible vehicle 2 of the first embodiment is provided with a tank 7, and the amount of water contained in the tank can be freely controlled. Since, therefore, the tank serves to control the buoyant force of the vehicle just like the swim bladder of a fish, the underwater position of the vehicle can be smoothly controlled.

Figure 5:
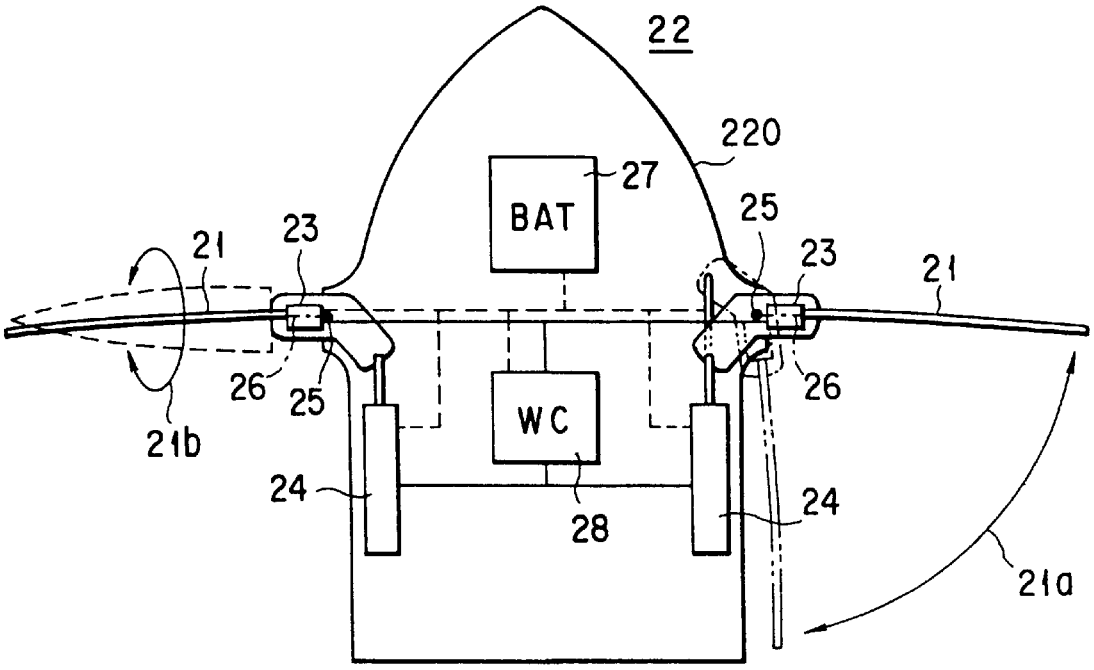
FIG. 5 is a plan view schematically showing the internal structure of a submersible vehicle with swinging wings, the submersible vehicle being obtained according to the second embodiment of the present invention.
Figure 6:
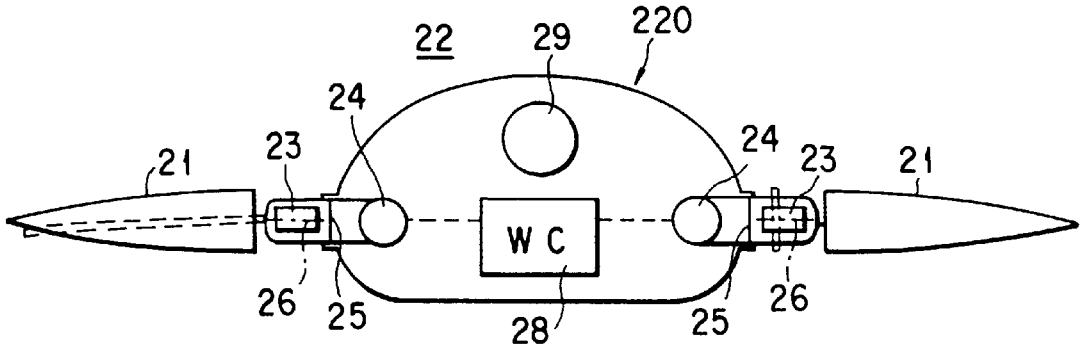
FIG. 6 is a front view schematically showing the internal structure of the submersible vehicle shown in FIG. 5.

A description will now be given of a submersible vehicle provided with swinging wings, which is according to the second embodiment of the present invention. As shown in FIGS. 5 and 6, the submersible vehicle of the second embodiment comprises a main body 220 and a propelling/steering mechanism (which is for propelling and/or steering). The propelling/steering mechanism used in this embodiment will be described.

Swinging wings 21 are coupled, at the proximal ends, to the side portions of the man body 220 of the submersible vehicle 22 of the second embodiment. The main body 220 has a first actuator 24 and a second actuator 23. When the first actuator 24 is driven, the wings 21 are swung around in a vertical axis by means of a vertical shaft 25, as indicated by 21*a* in FIG. 5. The first actuator 24 is normally made of a hydraulic or electric cylinder device. When the second actuator 23 is driven, the wings 21 are rotated on its own horizontal axis in a reversible fashion by a horizontal shaft 26, as indicated by 21*b* in FIG. 5. The second actuator is normally made of a motor. The propelling/steering mechanism will be described in more detail. Substantially "L"-shaped driving plates 221 are provided for the side portions of the main body 220. Each driving plate 221 is rotatably coupled to the main body 220 by means of the vertical shaft 25, which is located at the middle portion of the driving plate 221. The horizontal shaft 26 and the second actuator 23 is coupled to one end of the driving plate 221. The output shaft of the second actuator 23 and the horizontal shaft 26 are connected together such that they are axially rotatable as one body. The swinging wing 21 is attached to the horizontal shaft 26. With this structure, when the second actuator 23 is driven, the horizontal shaft 26 rotates the swinging wings 21, as indicated by 21*b* in FIG. 5. The first actuator 24 is attached to the main body 220. The output shaft of the first actuator 24 is coupled to the other end of the driving plate 221. When the first actuator 24 is driven, the horizontal shaft 26 swings the wings 21, as indicated by 21*a* in FIG. 5.

Figure 7:
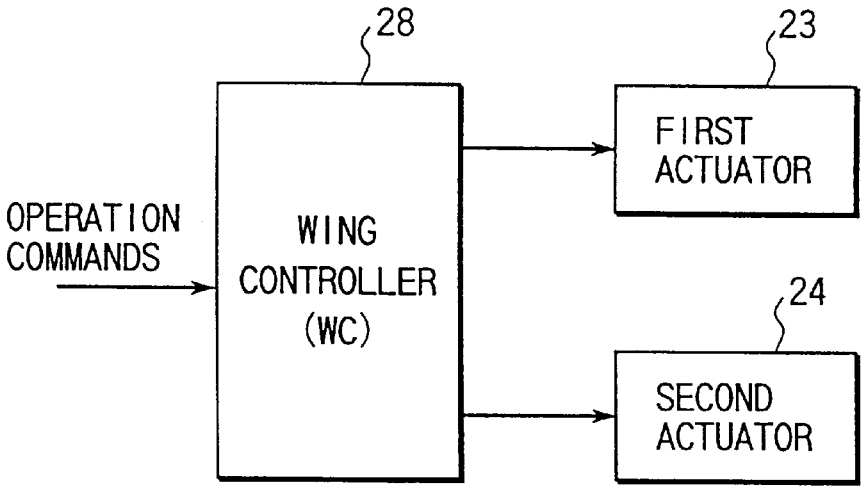
FIG. 7 is a block circuit diagram showing a wing control system employed in the submersible vehicle shown in FIGS. 5 and 6.

As shown in FIG. 7, a wing controller (WC) 28 is provided. This wing controller (WC) 28 controls the first and second actuators 24 and 23 on the basis of operating commands. Accordingly, the submersible vehicle 22 is propelled and steered by means of the swinging wings 21 provided at the respective sides of the main body 220 of the vehicle 22.

To control the sinking and floating (i.e., the underwater position), the submersible vehicle 22 of the second embodiment is provided with a tank (a swim bladder) 29, the amount of water in which can be controlled. The submersible vehicle 22 also comprises a control system (not shown) for controlling the amount of water poured into or drained from the tank 29. Reference numeral 27 in FIG. 5 denotes a battery (BAT) serving as a power source.

The wing controller (WC) 28 for controlling the swinging wings 21 of the above submersible vehicle is operated by following procedures C1 to C5 below:

(C1) A desired propelling force (i.e., a desired amount of operation) is expressed as a propelling force that should be applied to the center of gravity of the submersible vehicle 22.

(C2) The propelling force expressed in the manner indicated (C1) above is distributed to the right and left swinging wings 21, in such a manner that the propelling force becomes the sum of the propelling forces acting at the points of connection between the right and left swinging wings 21 and the main body of the vehicle 21.

(C3) On the basis of the propelling force distributed to each swinging wing 21, the swinging speed and the amplitude of the swinging wing are calculated. The first actuator 24 is controlled in such a manner that the angle of rotation of the vertical shaft 25 corresponds to the swinging speed and the amplitude.

(C4) The second actuator 23 is used for controlling the wing angles. In the case where the propelling force must act in the forward direction of the vehicle, the second actuator 23 makes the swinging wings horizontal when they are opened, so as to reduce the water resistance. The second actuator 23 makes the swinging wings vertical when they are closed, so as to produce a large propelling force. In the case where the propelling force must act in the backward direction of the vehicle, the second actuator 23 makes the swinging wings vertical when they are opened, so as to produce a large propelling force. The second actuator 23 makes the swinging wings horizontal when they are closed, so as to reduce the water resistance.

(C5) To steer the vehicle, propelling forces of different magnitudes are produced between the right and left swinging wings, so as to turn the submersible vehicle 22 in a desired direction.

As described above, in the submersible vehicle 22 of the second embodiment, the right and left swinging wings 21 work as if they were pectoral fins of a fish. Owing to the use of such swinging wings, the submersible vehicle 22 can be moved forward or backward and steered. It should be noted that the swinging wings 21 can be used as a rudder by controlling the angle of the wings 21.

As described above, the amount of water contained in the tank 2 can be adjusted, and the buoyant force of the vehicle can be controlled thereby. Since this feature is combined with the angle control of the swinging wings, the underwater position of the vehicle can be freely adjusted.

The swinging wings 21 are controlled by the wing controller (WC) 28 shown in FIG. 7. The wing controller (WC) 28 designates a cylinder stroke and supplies data thereon to the second actuator 23. In addition, the wing controller (WC) 28 designates a wing angle and supplies data thereon to the first actuator 23. The buoyant force control based on the tank 27 (the swim bladder) is similar to that of the first embodiment.

According to the second embodiment, it is possible to control the 6-axis movement, including the rotation of the swinging wings. In connection with this, the method for controlling the stroke and the angle will be described below, with reference to FIG. 6.

(D1) Measurement of Movable Range of Swinging Wings (Preparations)

(D1-1) The submersible vehicle 22 is fixed inside a water tank, and a sensor is attached to the main body 220 of the vehicle 22 so as to measure the force exerted on the point of connection between the submersible vehicle 22 and the swinging wings 21. The measurement of the force is made in the vertical direction, the widthwise direction of the vehicle and the longitudinal direction of the vehicle.

(D1-2) The stroke range of the first actuator 24 (used for controlling the swing angle) and the angle of the second actuator 23 (used for controlling the wing angle) are designated, and the force that is exerted on the point of connection between the submersible vehicle 22 and the swinging wing 21 during one swinging motion is measured.

(D1-3) The measurement noted in (D1-2) above is repeated, and the range of the force that can be applied in the vertical direction, the widthwise direction of the vehicle and the longitudinal direction of the vehicle is examined in relation to the stroke range and the wing angle. The data obtained thereby are described to form a database.

(D1-4) From the data of the database mentioned in (D1-3), the data on the stroke ranges corresponding to the cases where reciprocation (swinging movement) is enabled are extracted. The extracted data are combined to examine the force generated by the swinging wings 21 and the related swinging patterns.

(D1-5) Ratios determined between the swing speed of the wings and the force exerted on the point of connection are calculated.

(D2) Control of Swinging Wings:

(D2-1) The wing controller (WC) 28 distributes the force corresponding to the operating force supplied to the submersible vehicle 22 (i.e., the force applied to the submersible vehicle and the moment) to the right and left swinging wings 21. This distribution is executed in the non-linear programming method within the range determined by the direction and magnitude of the propelling force produced by the submersible vehicle.

(D2-2) The swing pattern that enables the generation of the force distributed to each swinging wing in (D2-1) above is determined on the basis of the data prepared in (D1) above.

(D2-3) The swing pattern determined in (D2-2) above is updated each time one swinging motion is performed, so as to control the first actuator 24 (used for controlling the swing angle) and the angle of the second actuator 23 (used for controlling the wing angle).

By combining this control method with the buoyant force control, it is possible to control the 6-axis movement (incl. rotation).

Figure 8:
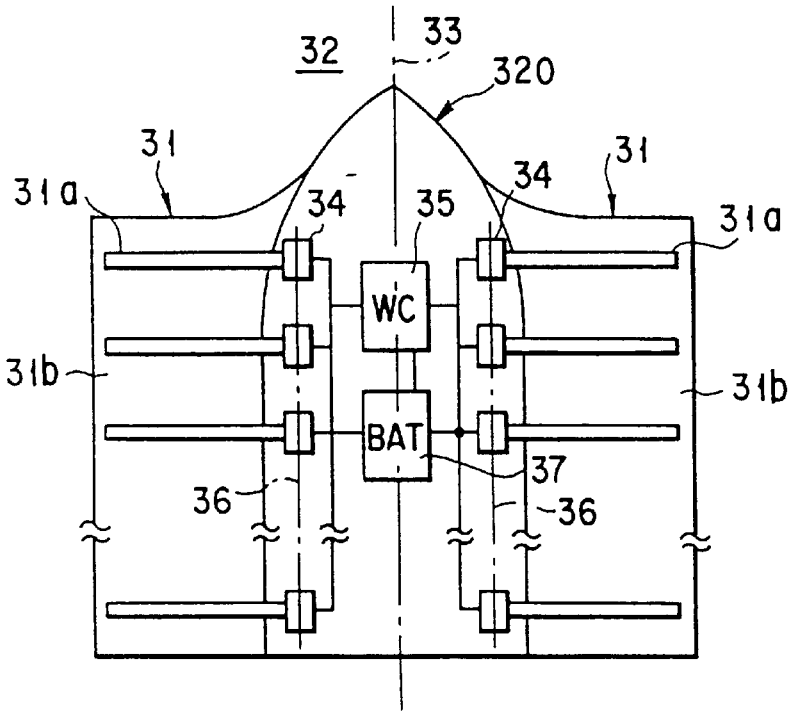
FIG. 8 is a plan view schematically showing the internal structure of a submersible vehicle with swinging wings, the submersible vehicle being obtained according to the third embodiment of the present invention.
Figure 9:
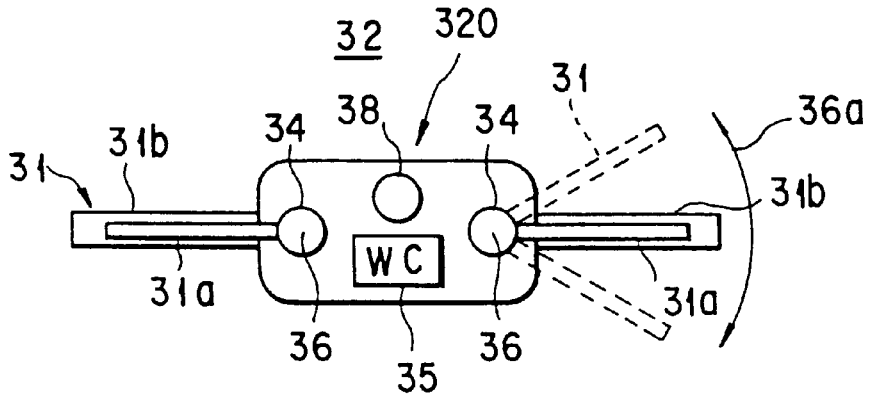
FIG. 9 is a front view schematically showing the internal structure of the submersible vehicle shown in FIG. 8.

A description will now be given of a submersible vehicle with swinging wings, according to the third embodiment of the present invention. As shown in FIGS. 8 and 9, the submersible vehicle 32 of the third embodiment comprises a main body 320 and a propelling/steering mechanism (i.e., a mechanism for propelling and/or steering). The propelling/steering mechanism used in this embodiment will be described.

According to the third embodiment, a large number of skeleton members 31*a* are coupled at proximal ends to the side portions of the main body 320 of the vehicle. The skeleton member 31*a* extend sideways and spaced from one another in the longitudinal direction of the vehicle in such a manner that they can be swung around axis 36 extending in the longitudinal axis of the vehicle, as indicated by 36*a* in FIG. 9.

A flexible wing member 31*b* is attached to the skeleton members 31*a*. In this manner, the skeleton members 31*a* and the flexible wing member 31*a* jointly constitute a swinging wing 31 of the third embodiment.

Figure 10:
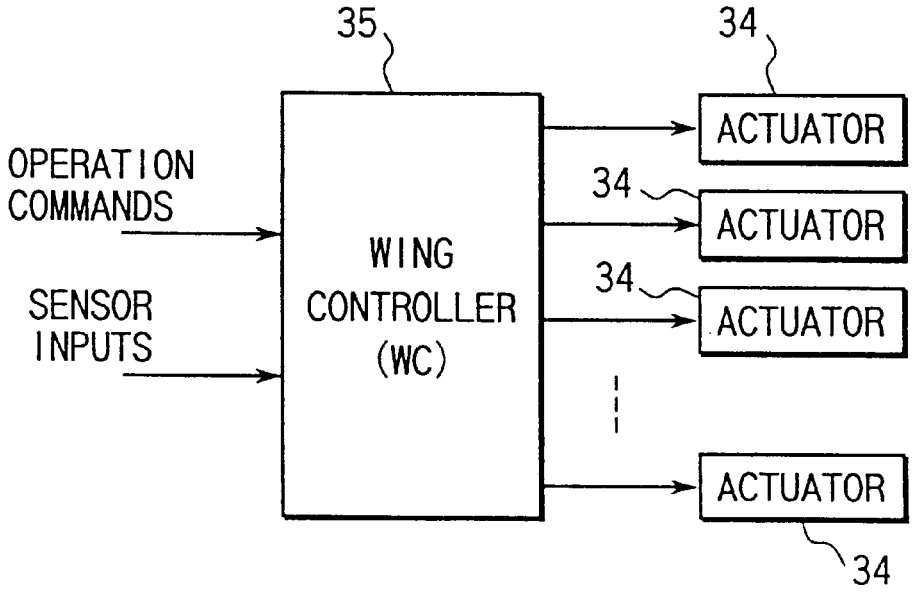
FIG. 10 is a block circuit diagram showing a wing control system employed in the submersible vehicle shown in FIGS. 8 and 9.

As shown in FIG. 10, a wing controller (WC) 35 for controlling actuators 34 and a battery (BAT) 37 serving as a power supply, are arranged inside the main body 320. The wing controller (WC) 35 controls individually controls the swinging motions of the skeleton members 31*a* by means of the actuators 34. With this structure, the swinging wings 31 can wave as if they were fins of a ray (fish), and the submersible vehicle 32 can be propelled or steered by utilization of the waving motion of the swinging wings 31.

To control the sinking and floating (i.e., the underwater position), the submersible vehicle 32 of the third embodiment is provided with a tank (a swim bladder) 38, the amount of water in which can be controlled. The submersible vehicle 32 also comprises a control system (not shown) for controlling the amount of water poured into the tank 38 or drained therefrom.

The wing controller (WC) 35 of the above submersible vehicle operates on the basis of the procedures E1 to E5 below.

(E1) A desired propelling force (i.e., a desired amount of operation) is expressed as a propelling force acting in the central axis of the vehicle and a moment acting around the center of gravity of that vehicle.

(E2) The propelling force and the moment indicated (E1) above are distributed to the right and left swinging wings 31, in such a manner that the they become the sum of the propelling forces acting in the direction of the central axis 33 of the vehicle.

(E3) The wing controller (WC) 35 controls the angles of the skeleton members in such a manner as to produce the propelling forces described in (E2) above. The magnitudes of the propelling forces are controlled on the basis of the angular velocities of the skeleton members 31*a* and the phase differences among the skeleton members 31*a*. To be more specific, the angular velocities and the phase differences are increased to produce a large propelling force, and are decreased to produce a small propelling force.

(E4) The direction in which the produced propelling force should act is controlled as follows. When the propelling force is used for moving the vehicle forward, the phases of the swinging motions (or oscillations) of the skeleton members 31*a* are delayed from the front-end skeleton member to the rear-end skeleton member.

(E5) To steer the vehicle, propelling forces of different magnitudes are produced between the right and left swinging wings 31, so as to turn the submersible vehicle 22 in a desired direction.

In the submersible vehicle of the third embodiment, the right and left swinging wings 31 can wave as if they were fins of a ray (fish), and the submersible vehicle 32 can be propelled or steered by utilization of the waving motion of the swinging wings 31. In addition, the swinging wings 31 can be used as a rudder of the submersible vehicle.

The amount of water contained in the tank 38 can be adjusted, and the buoyant force of the vehicle can be controlled thereby. Since this feature is combined with the motion control of the swinging wings, the. underwater position of the vehicle 32 can be freely adjusted.

The wing controller (WC) 35 distributes the propelling force and moment that should be applied to the submersible vehicle 35 to the right and left swinging wings 31. A swinging pattern by which the swinging wings 31 can produce the required swinging force is generated, and the actuators 34 are controlled, accordingly. The buoyant force control based on the tank 38 (the swim bladder) is similar to that of the first embodiment. How the swinging pattern is derived and how the control method is executed will be described in (F1) and (F2) below.

(F1) Calculation of Propelling Force (Preparations)

(F1-1) The submersible vehicle 32 is fixed inside a water tank, and a strain gauge is attached to the submersible vehicle 2 so as to measure the propelling force.

(F1-2) The actuators are swung based on a sinusoidal wave that enables maximal oscillation and maximal angular velocities.

(F1-3) In the state where the phase differences between adjacent actuators 34 are kept at the same fixed value, a propelling force is generated. The phase difference that corresponds to a maximal propelling force is obtained.

(F1-4) On the basis of the phase difference obtained in (F1-3) above and the intervals at which the skeleton members 31*a* are disposed, the velocity of the swinging motion waves is detected.

(F2) Control of Swinging Wing 31:

(F2-1) To start the control by the wing controller (WC) 35, the propelling force that should be applied to the submersible vehicle 32 in response to operating commands (a propelling force and a turning angle) is expressed as a propelling force acting in the central axis of the vehicle and a moment acting around the center of gravity of that vehicle.

(F2-2) The propelling force and the moment indicated (F2-1) above are distributed in such a manner that the they are expressed as a propelling force acting in the directions of right and left axes 36.

(F2-3) The propelling forces obtained in (F2-2) above is normalized on the basis of the maximal propelling force obtained in (F1) above, thereby calculating the swinging velocities of the actuators 34.

(F2-4) In consideration of outputs from sensors (such as a velocity of the submersible vehicle 32), the phase differences between the actuators are determined such that the velocity at which the swing-motion waves produced by the swinging wings move in water becomes equal to the velocity at which the swing-motion waves obtained in (F1).

(F2-5) The actuators 34 are controlled to produce the swing-motion waves obtained in (F2-5) and (F2-4) above.

As can be seen from the detailed descriptions given above, the present invention produces the advantages listed below.

(1) In a submersible vehicle, the wings, which are swung in accordance with the reversible rotation of the shafts 4 and 5 secured to the front edges of the wings, are arranged in series with each other, and the amplitudes, frequencies, centers of oscillation and phase of the wings cooperate with one another. Accordingly, the wings are driven smoothly as if they were like fins of a fish, such that a desired propelling force is generated and a desired steering operation is performed. Unlike the conventional screw propeller type submersible vehicle, the submersible vehicle does not catch objects around it.

(2) In the case where the rotating shafts of the submersible vehicle are arranged to extend horizontally, the wings can operate as if they were the rudder of a submarine or move as if they were pectoral fins of a fish. Accordingly, the periscope depth range or the underwater position of the vehicle can be varied.

(3) In the case where the submersible vehicle is provided with a tank with reference to which water can be poured or drained, the tank serves as if it were the swim bladder of a fish. In other words, the tank serves to control the buoyant force of the vehicle. Accordingly, the sinking and floating of the vehicle (i.e., the underwater position of the vehicle) can be smoothly controlled.

(4) The submersible vehicle may be provided with first actuators for oscillating or swinging the right and left wings and second actuators for controlling the wing angle of the swinging wings. Where such actuators are provided, the right and left swinging wings work as if they were pectoral fins of a fish, and the submersible vehicle can be moved forward or backward and steered. In addition, the swinging wings 21 can be used as a rudder by controlling the angle of the wings 21.

(5) Each of the right and left swinging wings of the submersible vehicle may be made up of: a large number of skeleton members swingable in the vertical direction; and a flexible wing member attached to the skeleton members. The right and left swinging wings having this structure can be controlled in such a manner as to move like fins of a ray. By utilization of this motion of the wings, the submersible vehicle can be moved forward or backward, and steered. In addition, the wings can be used as a rudder by controlling the movement of the skeleton members.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A submersible vehicle provided with swinging wings, comprising:

a vehicle main body;

swinging wings provided for side portions of the vehicle main body;

a first actuator for swinging the wings around vertical axes;

a second actuator for rotating the swinging wings around horizontal axes; and a wing controller for controlling the first and second actuators such that the swinging wings work like pectoral fins, thereby causing the submersible vehicle to be propelled and steered.

2. A submersible vehicle provided with swinging wings, comprising:

a vehicle main body;

a swinging wing made up of a plurality of skeleton members and a flexible wing member attached to the skeleton members, said skeleton members having proximal ends which are pivotally coupled to side portions of the vehicle main body, and being swingable around axes which extend in a longitudinal direction of the submersible vehicle; and a wing controller for individually controlling swinging motions of the skeleton members such that the swinging wings enable to wave, thereby causing the submersible vehicle to be propelled and steered.

* * * * *